US009184485B2

(12) United States Patent
Yoshioka et al.

(10) Patent No.: US 9,184,485 B2
(45) Date of Patent: Nov. 10, 2015

(54) DIRECTIONAL COUPLER

(71) Applicant: Mitsubishi Electric Corporation, Tokyo (JP)

(72) Inventors: Hideharu Yoshioka, Tokyo (JP); Akimichi Hirota, Tokyo (JP); Tetsu Owada, Tokyo (JP); Shinsuke Watanabe, Tokyo (JP); Kazuhiro Iyomasa, Tokyo (JP); Kazuya Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 42 days.

(21) Appl. No.: 14/224,796

(22) Filed: Mar. 25, 2014

(65) Prior Publication Data

US 2014/0292439 A1 Oct. 2, 2014

(30) Foreign Application Priority Data

Mar. 29, 2013 (JP) ..... 2013-072993

(51) Int. Cl.
*H01P 5/18* (2006.01)
*H01P 3/08* (2006.01)

(52) U.S. Cl.
CPC ..... *H01P 5/187* (2013.01)

(58) Field of Classification Search
CPC ..... H01P 5/18; H01P 3/08
USPC ..... 333/109, 112, 116
See application file for complete search history.

(56) References Cited

U.S. PATENT DOCUMENTS

| | | | | |
|---|---|---|---|---|
| 4,013,981 | A * | 3/1977 | Shintani et al. | 333/28 R |
| 6,972,638 | B2 * | 12/2005 | Usami et al. | 333/109 |
| 7,088,201 | B2 * | 8/2006 | Piernas | 333/116 |
| 7,157,986 | B1 * | 1/2007 | Wu et al. | 333/26 |
| 7,907,032 | B2 * | 3/2011 | Yamamoto et al. | 333/116 |
| 8,289,102 | B2 * | 10/2012 | Yamamoto et al. | 333/116 |
| 8,315,576 | B2 * | 11/2012 | Jones | 455/78 |
| 8,922,295 | B2 * | 12/2014 | Haruna | 333/116 |
| 2014/0375395 | A1 * | 12/2014 | Suga et al. | 333/116 |

FOREIGN PATENT DOCUMENTS

JP 3169820 B2 5/2001

OTHER PUBLICATIONS

David M. Pozar, "Microwave Engineering—Second Edition" p. 384, John Wiley & Sons. Inc., 1998.

Hideharu Yoshioka, et al., "A Characteristic Improvement Method of Directional Couplers Using an Additional Coupled Line with Reverse Phase Forward Coupling" p. 111, C-2-86, 2013 IEICE.

* cited by examiner

*Primary Examiner* — Dean Takaoka
(74) *Attorney, Agent, or Firm* — Studebaker & Brackett PC

(57) ABSTRACT

Disclosed is a directional coupler including a broadside coupled line 1031 provided with a main signal line conductor 1001 and a secondary signal line conductor 1011 arranged in parallel with the main signal line conductor 1001, and an offset broadside coupled line 1032 provided with a main signal line conductor 1002 having an end portion connected to an end portion of the main signal line conductor 1001 and a second secondary signal line conductor 1012 having an end portion connected to an end portion of the secondary signal line conductor 1011, and arranged in parallel with the main signal line conductor 1002, in which a coupled line impedance in the broadside coupled line 1031 is lower than a terminal impedance and a coupled line impedance in the offset broadside coupled line 1032 is higher than the terminal impedance.

10 Claims, 7 Drawing Sheets

DIRECTIONAL COUPLER

BACKGROUND OF THE INVENTION

1. Field of the Invention

The present invention relates to a directional coupler used in a microwave band or the like.

2. Description of Related Art

A directional coupler is widely used in order to carry out monitoring of electric power. As a directional coupler, there is a directional coupler having a structure of arranging two lines in a vertical direction (for example, refer to the following nonpatent reference 1). Because two lines are thus arranged in a vertical direction, coupling (broadside coupling) occurs electrically. As a result, a directional coupler can be implemented.

RELATED ART DOCUMENT

Nonpatent reference 1: David M. Pozar, "Microwave Engineering—Second Edition" (pp. 384, John Wiley & Sons. Inc., published in 1998)

A problem with the conventional directional coupler is, however, that when the two coupled lines are bent for downsizing, a difference occurs between the passing phase in the bent portion at the time of even mode operation and that at the time of odd mode operation, and hence the directivity degrades. Further, in a case in which a directional coupler is constructed of a microstrip line or a triplate line, there is a case in which the reflection property and the isolation quantity of the directional coupler are minimized and a coupled line impedance maximizing the coupling amount is lower than a terminal impedance connected to each terminal of the coupler because of constraints on manufacturing, such as a substrate thickness and a line width. A problem is that because when the coupled line impedance is lower than the terminal impedance, the passing phase at the time of even mode operation leads against that at the time of odd mode operation, a phase difference occurs between the passing phase at the time of even mode operation and that at the time of odd mode operation, and hence the directivity degrades.

SUMMARY OF THE INVENTION

The present invention is made in order to solve the above-mentioned problems, and it is therefore an object of the present invention to provide a directional coupler that can avoid degradation of its isolation characteristics even when having a bending structure, and can provide good directivity even when its coupled line impedance is lower than a terminal impedance connected to each terminal of the coupler because of constraints on manufacturing.

In accordance with the present invention, there is provided a directional coupler including: a first coupler provided with a first main signal line conductor and a first secondary signal line conductor arranged in parallel with the first main signal line conductor; and a second coupler provided with a second main signal line conductor having an end portion connected to an end portion of the first main signal line conductor, and a second secondary signal line conductor having an end portion connected to an end portion of the first secondary signal line conductor, and arranged in parallel with the second main signal line conductor, in which a first coupled line impedance in the first coupler is lower than a terminal impedance and a second coupled line impedance in the second coupler is higher than the terminal impedance.

In accordance with the present invention, the first coupled line impedance in the first coupler is lower than the terminal impedance and the second coupled line impedance in the second coupler is higher than the terminal impedance. Therefore, because the isolations of the first and second couplers have equal amplitudes and phases nearly opposite to each other, the isolations of the first and second couplers cancel each other. As a result, there is provided an advantage of being able to provide a directional coupler that can avoid degradation of its isolation characteristics even when having a bending structure, and can provide good directivity even when its coupled line impedance is lower than the terminal impedance connected to each terminal of the coupler because of constraints on manufacturing.

Further objects and advantages of the present invention will be apparent from the following description of the preferred embodiments of the invention as illustrated in the accompanying drawings.

DETAILED DESCRIPTION OF THE PREFERRED EMBODIMENTS

Embodiment 1

Figure 1A:
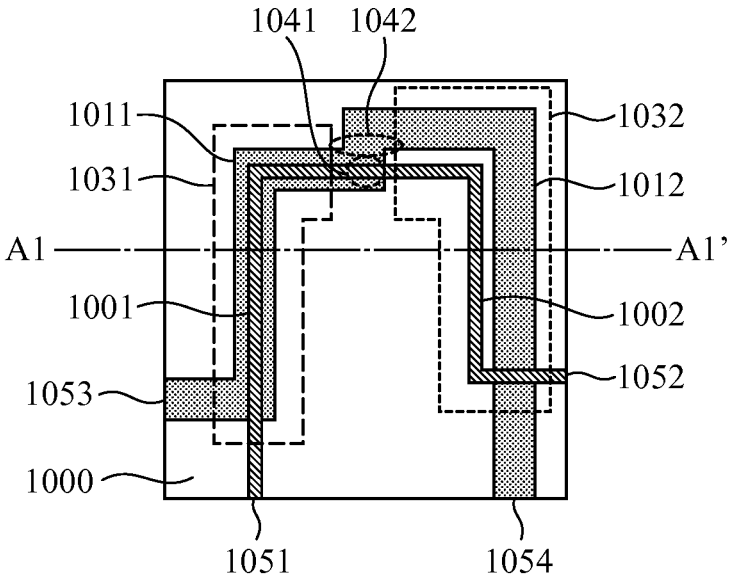
FIGS. 1A, 1B and 1C are block diagrams showing a directional coupler in accordance with Embodiment 1 of the present invention.

Hereafter, the preferred embodiments of a directional coupler in accordance with the present invention will be explained with reference to the drawings. In each of the views, the same reference numerals refer to the same elements or like elements.

Figure 1B:
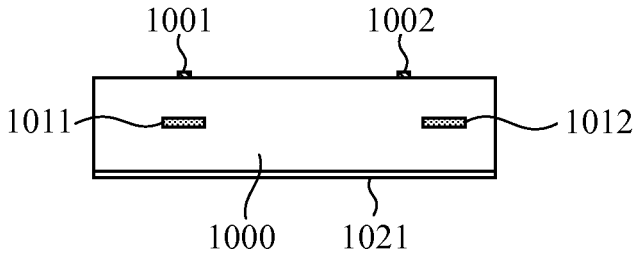
Figure 1C:
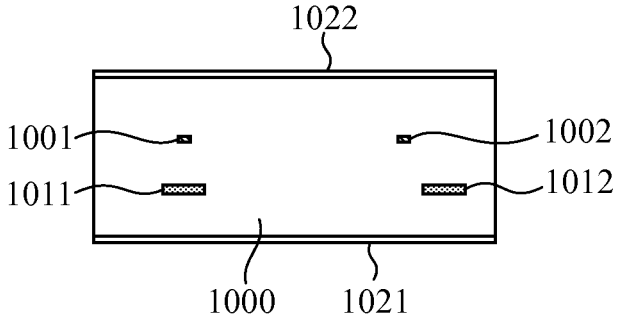

FIG. 1 is a block diagram showing a directional coupler in accordance with Embodiment 1 of the present invention. FIG. 1(*a*) is a top perspective view, and FIG. 1(*b*) is a cross-sectional view taken on the plane of the line A1-A1' of FIG. 1(*a*). The directional coupler in accordance with Embodiment 1 uses a microstrip line.

As shown in FIGS. 1(*a*) and 1(*b*), the structure of the directional coupler in accordance with Embodiment 1 is formed of a main signal line conductor 1001 and a main signal line conductor 1002 disposed on an identical plane in an upper layer of a dielectric substrate 1000, a secondary signal line conductor 1011 and a secondary signal line conductor 1012 disposed on an identical plane in a middle layer of the dielectric substrate 1000, and a ground conductor 1021 disposed in a lower layer of the dielectric substrate 1000.

Further, the main signal line conductor 1001 and the secondary signal line conductor 1011 are arranged close to each other in such a way as to be coupled electromagnetically, and the main signal line conductor 1002 and the secondary signal line conductor 1012 are arranged close to each other in such a way as to be coupled electromagnetically. The main signal line conductor 1001 and the secondary signal line conductor 1011 arranged directly below the main signal line conductor 1001 construct a broadside coupled line 1031. In addition, the main signal line conductor 1002 and the secondary signal line conductor 1012 which is shifted in parallel with the main signal line conductor 1002 from a position directly below the main signal line conductor 1002 in such a way as to be arranged offset from and along the main signal line conductor 1002 construct an off set broadside coupled line 1032.

In this case, the distance between the main signal line conductor 1001 and the secondary signal line conductor 1011 is shorter than the distance between the main signal line conductor 1002 and the secondary signal line conductor 1012, and the line lengths of the main signal line conductor 1001 and the secondary signal line conductor 1011 are shorter than the line length between the main signal line conductor 1002 and the secondary signal line conductor 1012.

The main signal line conductor 1001 is connected to an end portion of the main signal line conductor 1002 at a connector 1041, and the main signal line conductor 1001 is connected to a terminal 1051 and the main signal line conductor 1002 is connected to a terminal 1052. Similarly, the secondary signal line conductor 1011 is connected to an end portion of the secondary signal line conductor 1012 at a connector 1042, and the secondary signal line conductor 1011 is connected to a terminal 1053 and the secondary signal line conductor 1012 is connected to a terminal 1054.

Referring to FIG. 1, the main signal line conductor 1001 and the secondary signal line 1011 have a bending structure in the coupled line 1031, and the main signal line conductor 1002 and the secondary signal line 1012 have a bending structure in the coupled line 1032.

The coupled line impedance of the broadside coupled line 1031 is determined in such away as to be lower than the terminal impedance connected to each terminal, and the coupled line impedance of the offset broadside coupled line 1032 is determined in such a way as to be higher than the terminal impedance connected to each terminal. The terminal impedance minimizing the reflection property and the isolation quantity of a coupled line as the terminal impedance connected to each terminal of the coupled line is changed is the coupled line impedance of the coupled line.

Typically, the coupled line impedance Z is expressed by equation (1) using an impedance Ze at the time of even mode operation, and an impedance Zo at the time of odd mode operation.

$$Z=\sqrt{Z_e Z_o} \tag{1}$$

Because a difference occurs between the passing phase in each bent portion at the time of even mode operation and that at the time of odd mode operation in the directional coupler shown in FIG. 1, the electric power inputted to the terminal 1051 is outputted to the connector 1041 and the terminal 1053 in the broadside coupled line 1031 while slight electric power is outputted to the connector 1042 because this connector is an isolation terminal. Similarly, under the influence of each bent portion, the electric power inputted to the offset broadside coupled line 1032 from the connector 1041 is outputted to the terminal 1052 and the connector 1042 while slight electric power is outputted to the terminal 1054 because this terminal is an isolation one.

Figure 2:
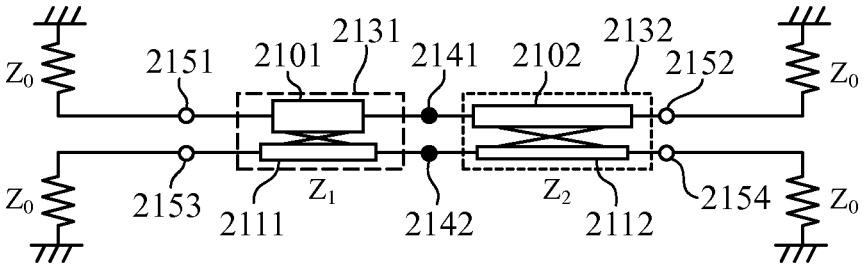
FIG. 2 is an equivalent circuit diagram showing the directional coupler in accordance with Embodiment 1 of the present invention.

Next, the directional coupler in accordance with Embodiment 1 will be explained by using an equivalent circuit. FIG. 2 shows the equivalent circuit of the directional coupler shown in FIG. 1.

In FIG. 2, each signal line shown in FIG. 1 is represented by a signal line model. The main signal line conductor 1001 is represented by a signal line model 2101, the main signal line conductor 1002 is represented by a signal line model 2102, the secondary signal line conductor 1011 is represented by a signal line model 2101, and the secondary signal line conductor 1012 is represented by a signal line model 2112. Further, the signal line model 2101 and the signal line model 2111 construct a coupled line model 2131, and the signal line model 2102 and the signal line model 2112 construct a coupled line model 2132.

In the equivalent circuit shown in FIG. 2, the connector 1041 shown in FIG. 1 is represented by a connection point 2141, and the connector 1042 shown in FIG. 1 is represented by a connection point 2142. Further, the terminal 1051, the terminal 1052, the terminal 1053, and the terminal 1054 which are shown in FIG. 1 are represented by an end portion 2151, an end portion 2152, an end portion 2153, and an end portion 2154, respectively. In the equivalent circuit, the terminal impedance connected to each end portion is expressed by Z0, the coupled line impedance of the coupled line model 2131 is expressed by Z1, and the coupling impedance of the coupled line model 2132 is expressed by Z2.

Because the coupling impedance of the coupled line model 2131 is lower than the terminal impedance when the following condition: $Z1<Z0<Z2$ is established, the coupled line 1031 has a low impedance, while because the coupling impedance of the coupled line model 2132 is higher than the terminal impedance, the coupled line 1032 has a high impedance. At this time, a large phase difference occurs between the isolations of the two coupled lines.

Further, by adjusting the difference between the two coupling impedances, the phase difference between the isolations of the two coupled lines can be brought close to 180 degrees. In addition, by adjusting the coupling lengths of the two coupled lines, the isolations of the two coupled lines can be made to have equal amplitudes.

Figure 3A:
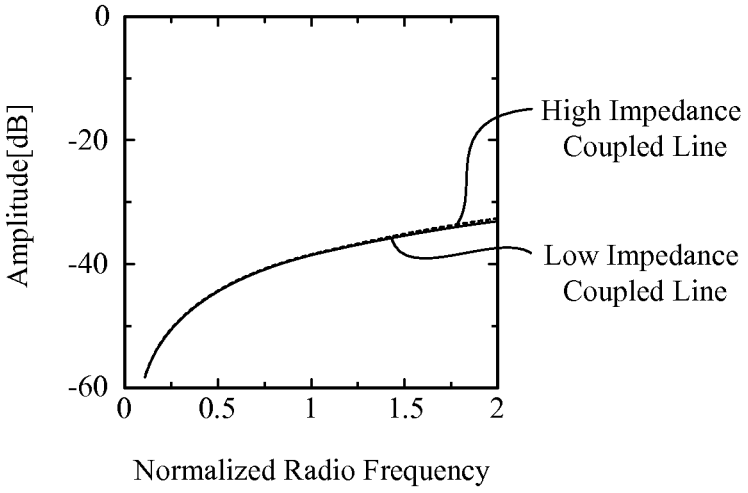
FIGS. 3A and 3B are characteristic diagrams showing the amplitudes and the phases of the isolations of two coupled lines.
Figure 3B:
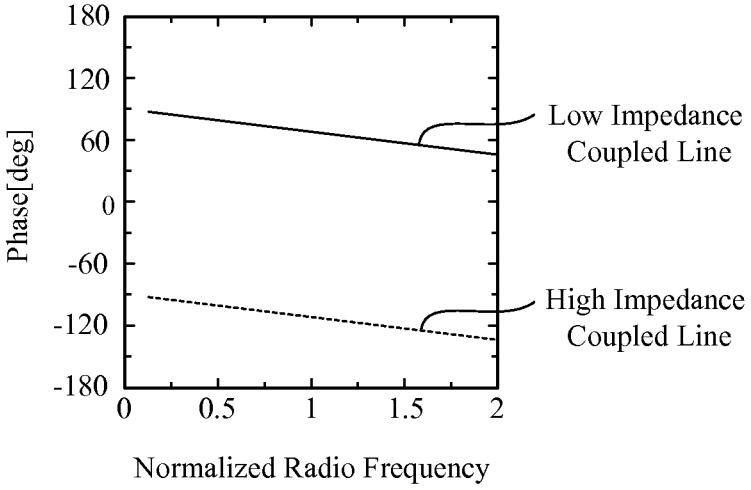

As a calculation example in the case in which this condition is satisfied, the amplitudes of the isolations of the two coupled lines are shown in FIG. 3(*a*), and the phases of the isolations are shown in FIG. 3(*b*). The coupling impedance of the low impedance coupled line is calculated to be 44 ohm and the coupling impedance of the high impedance coupled line is calculated to be 59 ohm with the calculations being done by assuming that their electric lengths are 10 deg. A solid line shows the characteristics of the low impedance coupled line, and a dashed line shows the characteristics of the high impedance coupled line. It can be seen from these results that when the following condition: $Z1<Z0<Z2$ is established, the isolations of the two coupled lines have amplitudes nearly equal to each other and a phase difference nearly equal to 180 degrees.

As mentioned above, in accordance with Embodiment 1, the coupled line impedance of the coupled line 1031 is made to be lower than the terminal impedance connected to the termination of each terminal because the coupled line is constructed as a broadside coupled line, while the coupled line impedance of the coupled line 1032 is made to be higher than the terminal impedance connected to the termination of each terminal because the coupled line is constructed as an offset broadside coupled line. As a result, the phase difference between the isolations of the two coupled lines can be brought close to 180 degrees. In the broadside coupled line 1031, because the isolation outputted to the connector 1042 is outputted to the terminal 1054 by way of the secondary signal line conductor 1012, a combination of the isolation of the broadside coupled line 1031 and that of the offset broadside coupled line 1032 is outputted to the terminal 1054. Because the combined isolations of the two couplings have equal amplitudes, and the phase difference between them is increased by adjusting the coupling lengths of the two coupled lines, the isolations can be made to cancel each other out, and the degradation in the isolations can be avoided also as the bending structure and the characteristics are improved. As a result, the directivity of the directional coupler having the broadside coupled line 1031 and the offset broadside coupled line 1032 is improved.

In Embodiment 1, the microstrip line type coupled lines in which the ground conductor 1021 is formed in the bottom layer of the dielectric substrate 1000, and the main signal line conductors 1001 and 1002 are arranged in the upper layer are shown. This embodiment is not limited to this example. The main signal line conductors 1001 and 1002 can be alternatively arranged in an inner layer of the dielectric substrate 1000. FIG. 1(*c*) is a cross-sectional view, taken on the plane of the line A1-A1' of FIG. 1(*a*), in the case of using each of the coupled lines as a strip line form. As shown in FIG. 1(*c*), a ground conductor 1022 can be disposed in a top layer opposite to the surface on which the ground conductor 1021 of the dielectric substrate 1000 is formed, and each of the coupled lines can be used as a strip line form.

Further, in Embodiment 1, as shown in FIG. 1, in the off set broadside coupled line 1032, the secondary signal line conductor 1012 is shifted toward the perimeter of the dielectric substrate 1000 in parallel with the secondary signal line conductor 1011 in such a way as to be arranged offset from and along the main signal line conductor 1002. This embodiment is not limited to this example. As an alternative, the secondary signal line conductor 1012 can be shifted toward the center of the dielectric substrate 1000 in parallel with the secondary signal line conductor 1011 in such a way as to be arranged offset from and along the main signal line conductor 1002.

Figure 4:
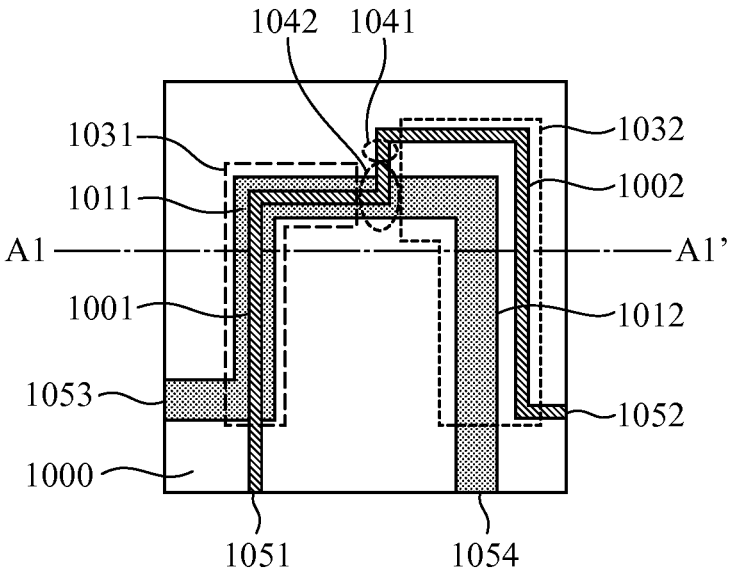
FIG. 4 is a block diagram showing another directional coupler in accordance with Embodiment 1 of the present invention.

In addition, as shown in FIG. 4, in the off set broadside coupled line 1032, the secondary signal line conductor 1012 can be arranged in parallel with the secondary signal line conductor 1011 without being shifted toward the perimeter or center of the dielectric substrate 1000, while the main signal line conductor 1002 can be shifted toward the perimeter or center of the dielectric substrate 1000 in parallel with the main signal line conductor 1001 in such a way as to be arranged offset from and along the secondary signal line conductor 1012. Referring to FIG. 4, the main signal line conductor 1001 and the secondary signal line 1011 have a bending structure in the coupled line 1031, and the main signal line conductor 1002 and the secondary signal line 1012 have a bending structure in the coupled line 1032.

Figure 5:
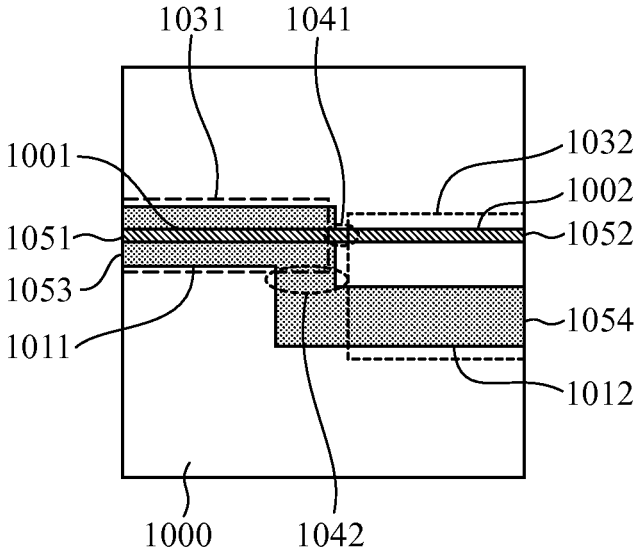
FIG. 5 is a block diagram showing another directional coupler in accordance with Embodiment 1 of the present invention.

Further, as shown in FIG. 5, the present embodiment can be applied to a case in which the main signal line conductor 1001 and the secondary signal line 1011 have a linear structure in the coupled line 1031, and the main signal line conductor 1002 and the secondary signal line 1012 have a linear structure in the coupled line 1032.

In addition, in Embodiment 1, as shown in FIG. 1, the coupled line 1031 is constructed in the form of a broadside coupled line, and the coupled line 1032 is constructed in the form of an offset broadside coupled line. This embodiment is not limited to this example. As an alternative, the coupled line 1031 can be constructed in the form of an offset broadside coupled line, and the coupled line 1032 can be constructed in the form of a broadside coupled line.

Further, in Embodiment 1, an explanation is made with reference to FIG. 2 by making a comparison between the coupled line impedance and the terminal impedance Z0 connected to each end portion, and assuming that the coupled line model 2131 is a low impedance coupled line, and the coupled line model 2132 is a high impedance coupled line. This embodiment is not limited to this example. As an alternative, the coupled line model 2131 can be used as a high impedance coupled line, and the coupled line model 2132 can be used as a low impedance coupled line.

In addition, in Embodiment 1, the example in which the main signal line conductors 1001 and 1002 are arranged in a higher layer of the dielectric substrate 1000 than that in which the secondary signal line conductors 1011 and 1012 are arranged is shown. This embodiment is not limited to this example. As an alternative, the main signal line conductors 1001 and 1002 can be arranged in a lower layer of the dielectric substrate 1000 than that in which the secondary signal line conductors 1011 and 1012 are arranged.

Further, the main signal line conductors 1001 and 1002 can be arranged in the same layer as that in which the secondary signal line conductors 1011 and 1012 are arranged. In this case, instead of constructing the coupled line 1031 in the form of a broadside coupled line and constructing the coupled line 1032 in the form of an offset broadside coupled line, the secondary signal line conductors 1011 and 1012 can be arranged on a side portion in the same plane as that in which the main signal line conductors 1001 and 1002 are arranged, the gap between the main signal line conductor 1001 and the secondary signal line conductor 1011, the gap between the main signal line conductor 1002 and the secondary signal line conductor 1012, and the width of each signal line conductor can be adjusted in such a way that one of the coupling impedances of the two coupled lines is higher than the terminal impedance connected to each terminal and the other one of the coupling impedances of the two coupled lines is lower than the terminal impedance connected to each terminal.

In Embodiment 1, the shape in which the coupled lines are formed into a two-stage structure having a high impedance coupled line and a low impedance coupled line is explained. As an alternative, the coupled lines can be formed into a three-or-more-stage structure. In this case, the isolation of each coupled line does not necessarily have an equal amplitude, and the sum of the amplitudes of the isolations of coupled lines in phase should only be equal to the amplitude of the isolation of a coupled line whose phase is opposite to the phase of the former coupled lines.

In addition, the main signal line conductor constructing each coupled line can be arranged in a different layer by way of a via and used, and the secondary signal line conductor constructing each coupled line can be similarly arranged in a different layer.

Further, in Embodiment 1, the directional coupler using the dielectric substrate is explained as an example. This embodiment is not limited to this example. The directional coupler can have any type of structure as long as the directional coupler corresponds to the equivalent circuit shown in FIG. 2.

Embodiment 2

Figure 6A:
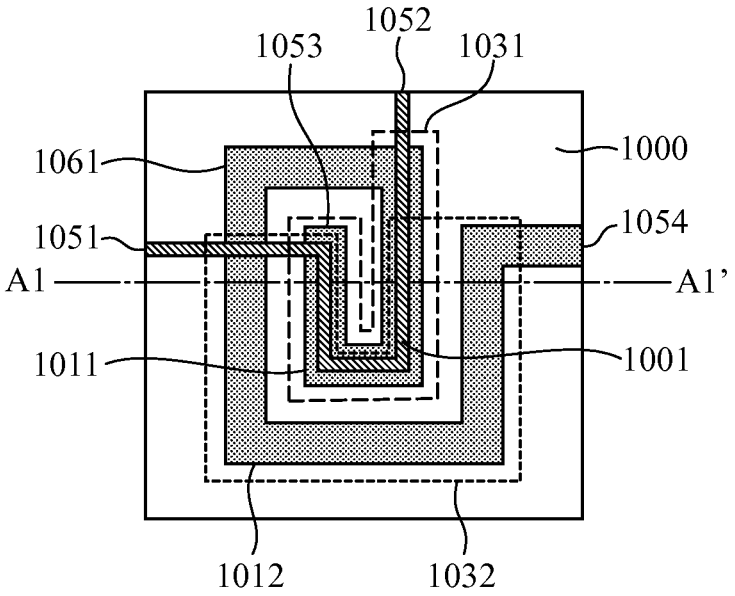
FIGS. 6A, 6B and 6C are block diagrams showing a directional coupler in accordance with Embodiment 2 of the present invention.
Figure 6B:
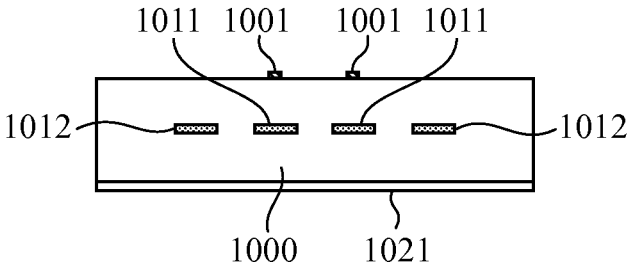
Figure 6C:
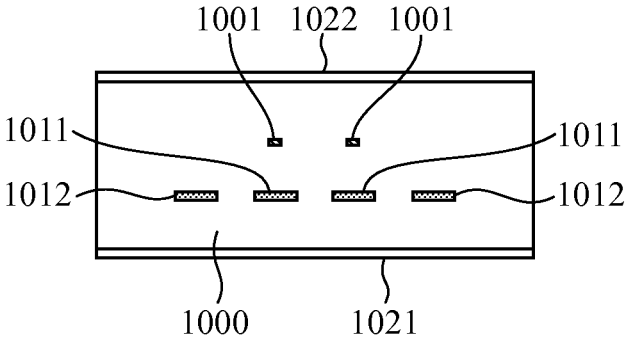

FIG. 6 is a block diagram showing a directional coupler in accordance with Embodiment 2 of the present invention. FIG.

6(*a*) is a top perspective view. FIG. 6(*b*) is a cross-sectional view taken on the plane of the line A1-A1' of FIG. 6(*a*). The directional coupler in accordance with Embodiment 2 uses a microstrip line.

The structure of the directional coupler in accordance with Embodiment 2 shown in FIG. 6 differs from that of the directional coupler in accordance with Embodiment 1 shown in FIG. 1 in the following points. The directional coupler has, as main signal line conductors, only a main signal line conductor 1001 including a main signal line conductor 1002. A secondary signal line conductor 1012 is shifted in parallel with the main signal line conductor 1001 from directly below the main signal line conductor 1001 to the perimeter of a dielectric substrate 1000 in such a way as to be arranged offset from and along the main signal line conductor 1001. A coupled line 1032 constructed in the form of an offset broadside coupled line is formed by the main signal line conductor 1001 and the secondary signal line conductor 1012, so that the main signal line conductor 1001 is shared by a coupled line 1031 and the coupled line 1032. A secondary signal line conductor 1011 is connected to the secondary signal line conductor 1012 by using a bypass signal line conductor 1061 instead of using a connector 1042. A terminal 1051 is connected to a terminal impedance by way of a via. The other structural components of the directional coupler are the same as those in accordance with above-mentioned Embodiment 1, and therefore the explanation of the components will be omitted hereafter.

In the example shown in FIG. 6, the distance between the main signal line conductor 1001 and the secondary signal line conductor 1011 is shorter than the distance between the main signal line conductor 1001 and the secondary signal line conductor 1012. Further, the main signal line conductor 1001 and the secondary signal line 1011 have a bending structure in the coupled line 1031, and the main signal line conductor 1001 and the secondary signal line 1012 have a bending structure in the coupled line 1032.

Figure 7:
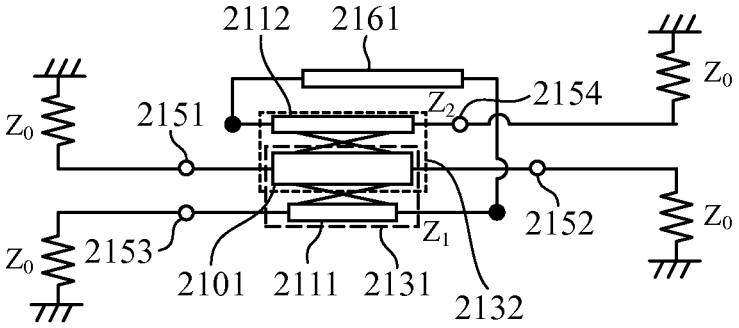
FIG. 7 is an equivalent circuit diagram showing the directional coupler in accordance with Embodiment 2 of the present invention.
Figure 8A:
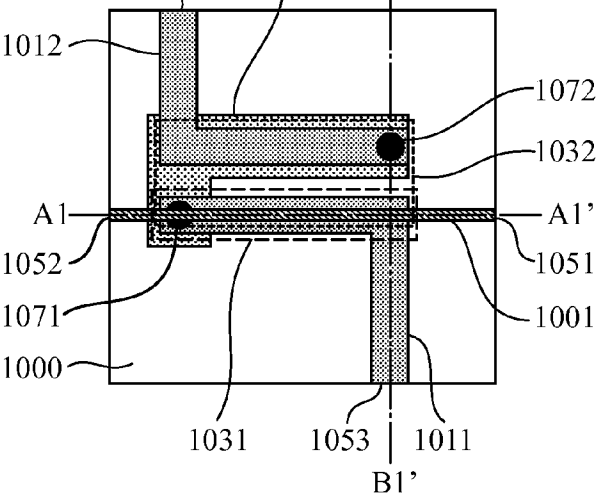
FIGS. 8A, 8B, 8C, 8D and 8E are block diagrams showing a directional coupler in accordance with Embodiment 3 of the present invention.
Figure 8B:
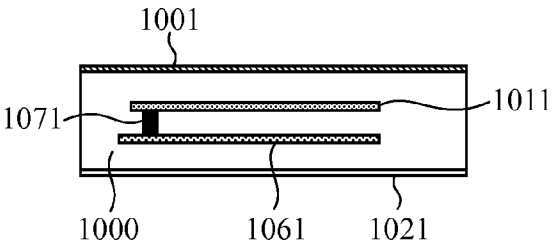
Figure 8C:
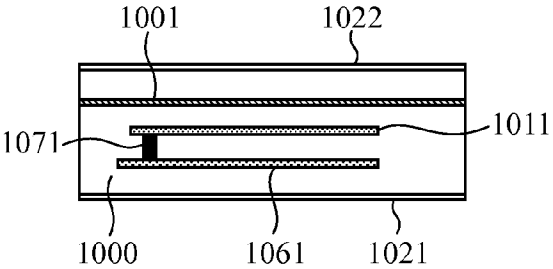
Figure 8D:
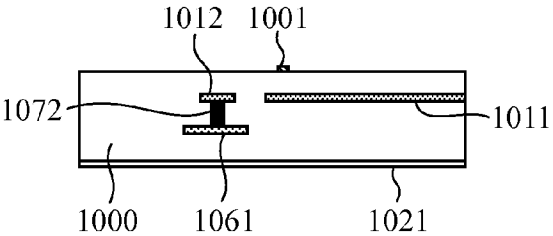
Figure 8E:
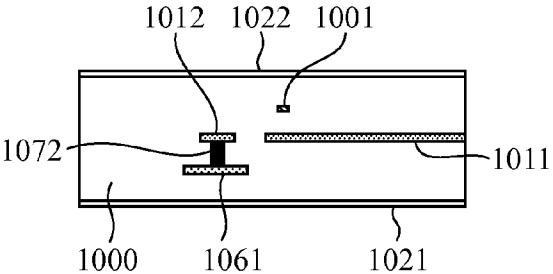
Figure 9A:
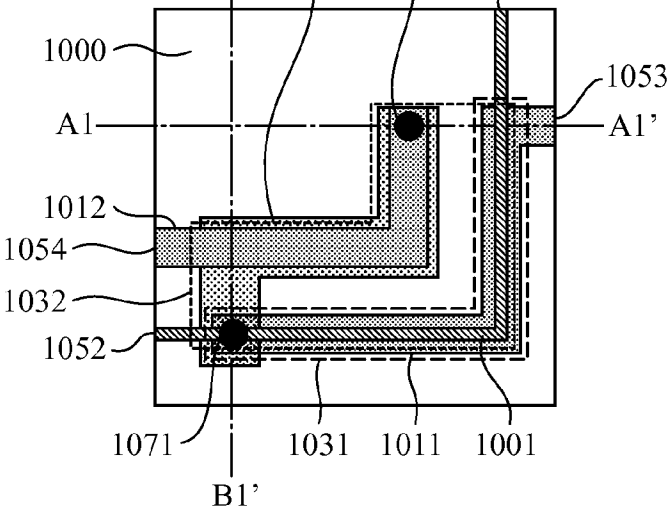
FIGS. 9A, 9B, 9C, 9D and 9E are block diagrams showing another directional coupler in accordance with Embodiment 3 of the present invention.
Figure 9B:
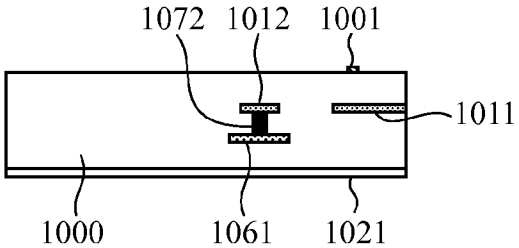
Figure 9C:
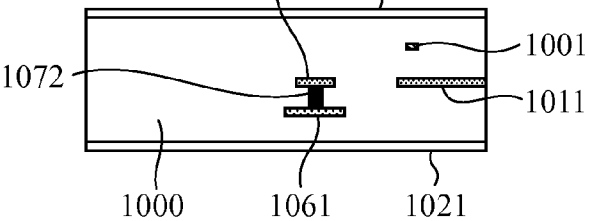
Figure 9D:
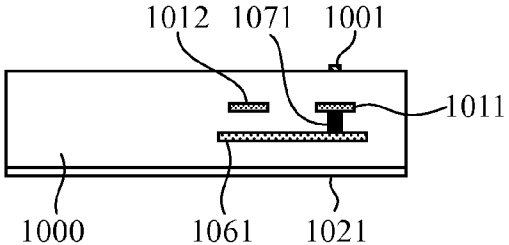
Figure 9E:
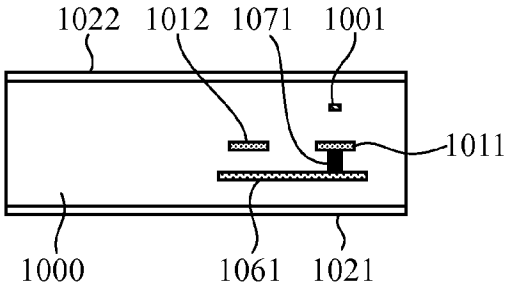

An equivalent circuit of the directional coupler in accordance with Embodiment 2 shown in FIG. 6 is shown in FIG. 7. The equivalent circuit of the directional coupler in accordance with Embodiment 2 shown in FIG. 7 differs from the equivalent circuit of the directional coupler in accordance with Embodiment 1 shown in FIG. 2 in the following points. Only a signal line model 2101 is included as signal line models, and the signal line model 2101 is shared by coupled line models 2131 and 2132. Signal line models 2111 and 2112 are connected to each other by using a bypass signal line model 2161. The other elements of the equivalent circuit of the directional coupler are the same as those in accordance with above-mentioned Embodiment 1, and therefore the explanation of the elements will be omitted hereafter.

Like in the case of above-mentioned Embodiment 1, the terminal impedance connected to each end portion is expressed by Z0, the coupled line impedance of the coupled line model 2131 is expressed by Z1, and the coupling impedance of the coupled line model 2132 is expressed by Z2. Therefore, because the coupling impedance of the coupled line model 2131 is lower than the terminal impedance when the following condition: $Z1<Z0<Z2$ is established, the coupled line 1031 has a low impedance, while because the coupling impedance of the coupled line model 2132 is higher than the terminal impedance, the coupled line 1032 has a high impedance. At this time, a large phase difference occurs between the isolations of the two coupled lines.

In addition, by adjusting the coupling lengths of the two coupled lines, the isolations of the two coupled lines can be made to have equal amplitudes.

As mentioned above, in accordance with Embodiment 2, a broadside coupling unit consists of the coupled line 1031 and an offset broadside coupling unit consists of the coupled line 1032. Therefore, because the isolation in the coupled line 1031 and the isolation in the coupled line 1032 can be made to have equal amplitudes and opposite phases, the degradation in the isolations can be avoided also as the bending structure, and the directivity can be improved, like in the case of above-mentioned Embodiment 1. Further, because the number of signal line conductors can be reduced as compared with the directional coupler in accordance with above-mentioned Embodiment 1, the directional coupler in accordance with Embodiment 2 can be downsized as compared with that in accordance with above-mentioned Embodiment 1 when they are used in the same frequency band.

In Embodiment 2, the secondary signal line conductor 1011 is arranged directly below the main signal line conductor 1001, and the secondary signal line conductor 1012 is shifted in parallel with the main signal line conductor 1001 from directly below the main signal line conductor 1001 to the perimeter of the dielectric substrate 1000 in such a way as to be arranged offset from and along the main signal line conductor 1001. This embodiment is not limited to this example. As an alternative, the secondary signal line conductor 1011 can be shifted in parallel with the main signal line conductor 1001 from directly below the main signal line conductor 1001 to the center of the dielectric substrate 1000 in such a way as to be arranged offset from and along the main signal line conductor 1001, and the secondary signal line conductor 1012 can be arranged directly below the main signal line conductor 1001.

Further, in Embodiment 2, only the main signal line conductor 1001 is provided as main signal line conductors, the secondary signal line conductor 1011 is arranged directly below the main signal line conductor 1001, the secondary signal line conductor 1012 is shifted in parallel with the main signal line conductor 1001 from directly below the main signal line conductor 1001 to the perimeter of the dielectric substrate 1000 in such a way as to be arranged offset from and along the main signal line conductor 1001, and the main signal line conductor 1001 is shared by the coupled lines 1031 and 1032. This embodiment is not limited to this example. As an alternative, only a secondary signal line conductor 1011 including a secondary signal line conductor 1012 can be provided as secondary signal line conductors, the main signal line conductor 1001 can be arranged directly above the secondary signal line conductor 1011, the main signal line conductor 1002 can be shifted in parallel with the secondary signal line conductor 1011 from directly above the secondary signal line conductor 1011 to the center or perimeter of the dielectric substrate 1000 in such a way as to be arranged offset from and along the secondary signal line conductor 1011, and the secondary signal line conductor 1011 can be shared by the coupled lines 1031 and 1032.

In addition, FIG. 6(*c*) is a cross-sectional view, taken on the plane of the line A1-A1' of FIG. 6(*a*), in the case of using each of the coupled lines as a strip line form. In Embodiment 2, as shown in FIG. 6(*c*), a ground conductor 1022 can be disposed in a top layer opposite to the surface on which the ground conductor 1021 of the dielectric substrate 1000 is formed, and each of the coupled lines can be used as a strip line form.

Embodiment 3

FIG. 8 is a block diagram showing a directional coupler in accordance with Embodiment 3 of the present invention. FIG. 8(*a*) is a top perspective view. FIG. 8(*b*) is a cross-sectional view taken on the plane of the line A1-A1' of FIG. 8(*a*), and FIG. 8(*d*) is a cross-sectional view taken on the plane of the line B1-B1' of FIG. 8(*a*). The directional coupler in accordance with Embodiment 3 uses a microstrip line.

The structure of the directional coupler in accordance with Embodiment 3 shown in FIG. 8 differs from the structure of the directional coupler in accordance with Embodiment 2 shown in FIG. 6 in the following points. A secondary signal line conductor 1011 is connected to one end portion of a bypass signal line conductor 1061 arranged directly below a secondary signal line conductor 1011 by way of a via 1071, and another end portion of the bypass signal line conductor 1061 arranged directly below a secondary signal line conductor 1012 is connected to the secondary signal line conductor 1012 by way of a via 1072. A terminal 1054 is not connected to a terminal impedance by way of a via. The other structural components of the directional coupler are the same as those in accordance with above-mentioned Embodiment 2, and therefore the explanation of the components will be omitted hereafter.

In the example shown in FIG. 8, the distance between a main signal line conductor 1001 and the secondary signal line conductor 1011 is shorter than the distance between the main signal line conductor 1001 and the secondary signal line conductor 1012. Further, the main signal line conductor 1001 and the secondary signal line 1011 have a linear structure in a coupled line 1031, and the main signal line conductor 1001 and the secondary signal line 1012 have a linear structure in a coupled line 1032.

In the example shown in FIG. 8, the bypass signal line conductor 1061 is disposed in a lower layer than that in which the secondary signal line conductors 1011 and 1012 are arranged. This embodiment is not limited to this example. As an alternative, the bypass signal line conductor 1061 can be disposed in a higher layer than that in which the secondary signal line conductors 1011 and 1012 are arranged.

As mentioned above, according to Embodiment 3, the directivity of the directional coupler is improved, like in the case of above-mentioned Embodiment 2. Further, as compared with the directional coupler in accordance with above-mentioned Embodiment 2, the degree of freedom of the layout design can be improved by arranging the bypass signal line conductor 1061 in a plane different from that in which the secondary signal line conductors 1011 and 1012 are arranged.

Further, FIG. 8(*c*) is a cross-sectional view, taken on the plane of the line A1-A1' of FIG. 8(*a*), in the case of using each of the coupled lines as a strip line form, and FIG. 8(*e*) is a cross-sectional view, taken on the plane of the line B1-B1' of FIG. 8(*a*), in the case of using each of the coupled lines as a strip line form. In Embodiment 3, as shown in FIGS. 8(*c*) and 8(*e*), a ground conductor 1022 can be disposed in a top layer opposite to the surface on which the ground conductor 1021 of the dielectric substrate 1000 is formed, and each of the coupled lines can be used as a strip line form.

In addition, in Embodiment 3, the main signal line conductor 1001 and the secondary signal line 1011 have a linear structure in the coupled line 1031, and the main signal line conductor 1001 and the secondary signal line 1012 have a linear structure in the coupled line 1032. This embodiment is not limited to this example. As shown in FIG. 9, the main signal line conductor 1001 and the secondary signal line 1011 can alternatively have a bending structure in the coupled line 1031, and the main signal line conductor 1001 and the secondary signal line 1012 can alternatively have a bending structure in the coupled line 1032. FIG. 9(*a*) is a top perspective view. FIG. 9(*b*) is a cross-sectional view taken on the plane of the line A1-A1' of FIG. 9(*a*), and FIG. 9(*d*) is a cross-sectional view taken on the plane of the line B1-B1' of FIG. 9(*a*). The directional coupler shown in FIGS. 9(*a*), 9(*b*), and 9(*d*) uses a microstrip line.

In addition, FIG. 9(*c*) is a cross-sectional view, taken on the plane of the line A1-A1' of FIG. 9(*a*), in the case of using each of the coupled lines as a strip line form, and FIG. 9(*e*) is a cross-sectional view, taken on the plane of the line B1-B1' of FIG. 9(*a*), in the case of using each of the coupled lines as a strip line form. As shown in FIGS. 9(*c*) and 9(*e*), a ground conductor 1022 can be disposed in a top layer opposite to the surface on which the ground conductor 1021 of the dielectric substrate 1000 is formed, and each of the coupled lines can be used as a strip line form.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

What is claimed is:

1. A directional coupler comprising:

a first coupler including a first main signal line conductor and a first secondary signal line conductor arranged in parallel with said first main signal line conductor; and a second coupler including a second main signal line conductor having an end portion connected to an end portion of said first main signal line conductor, and a second secondary signal line conductor having an end portion connected to an end portion of said first secondary signal line conductor, and arranged in parallel with said second main signal line conductor, wherein a first coupled line impedance in said first coupler is lower than a terminal impedance and a second coupled line impedance in said second coupler is higher than the terminal impedance.

2. The directional coupler according to claim 1, wherein said second main signal line conductor and said second secondary signal line conductor are arranged with a wider gap than that with which said first main signal line conductor and said first secondary signal line conductor are arranged.

3. The directional coupler according to claim 1, wherein any one or more of said first main signal line conductor, said second main signal line conductor, said first secondary signal line conductor, and said second secondary signal line conductor have at least one bending structure.

4. A directional coupler comprising:

a first coupler including a main signal line conductor and a first secondary signal line conductor arranged in parallel with said main signal line conductor;

a first coupler including said main signal line conductor and a second secondary signal line conductor arranged in parallel with said main signal line conductor; and a bypass signal line conductor that connects one end portion of said first secondary signal line conductor to an end portion of said second secondary signal line conductor on a side of another end portion of said first secondary signal line conductor, wherein a first coupled line impedance in said first coupler is lower than a terminal impedance and a second coupled line impedance in said second coupler is higher than the terminal impedance.

5. The directional coupler according to claim 4, wherein said main signal line conductor and said second secondary signal line conductor are arranged with a wider gap than that with which said main signal line conductor and said first secondary signal line conductor are arranged.

6. The directional coupler according to claim 4, wherein any one or more of said main signal line conductor, said first secondary signal line conductor, and said second secondary signal line conductor have at least one bending structure.

7. The directional coupler according to claim 4, wherein said main signal line conductor has at least two bending structures of bending in an identical direction.

8. The directional coupler according to claim 4, wherein said second secondary signal line conductor is arranged along a perimeter of said main signal line conductor.

9. The directional coupler according to claim 4, wherein said second secondary signal line conductor is arranged directly below and along said main signal line conductor.

10. The directional coupler according to claim 4, wherein said bypass signal line conductor is arranged in a plane different from that in which said first secondary signal line conductor and said second secondary signal line conductor are arranged.

* * * * *